US009361778B1

(12) United States Patent
German

(10) Patent No.: US 9,361,778 B1
(45) Date of Patent: Jun. 7, 2016

(54) HANDS-FREE ASSISTIVE AND PREVENTIVE REMOTE MONITORING SYSTEM

(71) Applicants: Gary German, Mt. Vernon, NY (US); Bruce S. Baumgarten, Syosset, NY (US)

(72) Inventor: Gary German, Mt. Vernon, NY (US)

( * ) Notice: Subject to any disclaimer, the term of this patent is extended or adjusted under 35 U.S.C. 154(b) by 0 days.

(21) Appl. No.: 14/212,423

(22) Filed: Mar. 14, 2014

Related U.S. Application Data

(60) Provisional application No. 61/800,638, filed on Mar. 15, 2013.

(51) Int. Cl.
*G08B 23/00* (2006.01)
*G08B 21/02* (2006.01)

(52) U.S. Cl.
CPC ..... *G08B 21/02* (2013.01)

(58) Field of Classification Search
CPC ..... E05G 1/00; E05G 2700/02; E05G 1/10; E05G 1/005; G07C 9/00912; A47B 81/005; G08B 21/0423; G08B 21/0446; G08B 21/0453; G06F 19/3418; G06F 19/322
USPC ..... 340/542, 573.1, 539.22; 109/38, 50; 600/301
See application file for complete search history.

(56) References Cited

U.S. PATENT DOCUMENTS 5,458,123 A * 10/1995 Unger ..... 600/509
5,544,649 A * 8/1996 David et al. ..... 600/301
5,905,436 A 5/1999 Dwight et al.
6,364,834 B1 * 4/2002 Reuss ..... A61B 5/0205 128/903
6,611,206 B2 * 8/2003 Eshelman et al. ..... 340/573.1
7,034,691 B1 * 4/2006 Rapaport et al. ..... 340/573.1
7,130,383 B2 * 10/2006 Naidoo ..... G08B 13/19669 348/143
7,210,240 B2 5/2007 Townsend et al.
7,248,059 B1 7/2007 Ochoco
7,567,200 B1 7/2009 Osterweil
7,589,637 B2 9/2009 Bischoff et al.
7,590,534 B2 9/2009 Vatland
7,701,332 B2 4/2010 Anderson
7,893,843 B2 2/2011 Bischoff
8,031,726 B2 10/2011 Ansari et al.
8,117,362 B2 2/2012 Rodriguez et al.
8,120,480 B2 2/2012 Anderson et al.
8,164,444 B2 4/2012 Anderson et al.
8,164,461 B2 4/2012 Bischoff
8,184,782 B1 5/2012 Vatland et al.
8,558,703 B2 * 10/2013 Edlund ..... G08B 21/0423 340/539.1
8,961,414 B2 * 2/2015 Teller et al. ..... 600/301
9,058,741 B2 * 6/2015 Steinhauer ..... G08C 17/02

(Continued)

*Primary Examiner* — Eric Blount
(74) *Attorney, Agent, or Firm* — Alfred M. Walker; John F. Vodopia

(57) ABSTRACT

A computer-based method operate to monitor a state of a person in a living space or the state of the living space to optimize the monitored person's well-being. The method includes arranging a plurality of sensors in predetermined positions within the living space for generating sensor data, connecting each of the sensors to a gateway node in the living space, the gateway node configured for routing signals to and from the sensors in the sensor network and operating a server including a processor and a memory that is programmed to communicate with the gateway node to control the sensors, receive data detected by the sensors, to process the sensor data received from the sensor network and to generate communications based on the processing in accordance with a set of rules.

20 Claims, 18 Drawing Sheets

(56) References Cited

U.S. PATENT DOCUMENTS

2007/0152837 A1* 7/2007 Bischoff et al. ..... 340/573.1
2008/0001735 A1* 1/2008 Tran ..... 340/539.22
2008/0172232 A1* 7/2008 Gurley ..... 704/251
2010/0145164 A1* 6/2010 Howell ..... 600/301
2013/0150686 A1* 6/2013 Fronterhouse ..... A61B 5/0205 600/323
2013/0346091 A1* 12/2013 Margon ..... 705/2
2013/0346511 A1* 12/2013 Park ..... G06Q 10/10 709/206
2014/0075464 A1* 3/2014 McCrea ..... 725/14

* cited by examiner

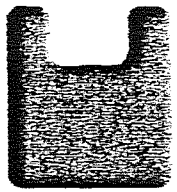

Toilet Sensor

- Allows caregiver to be become aware of frequent trips to the bathroom, which could indicate a problem such as a urinary tract infection
- Know when senior is in the bathroom if they are actually using the toilet to learn of a potential problem versus those times when just using bathroom to shower or wash hands
- Sensor is water resistant and can be covered by a toilet mat so it won't be seen

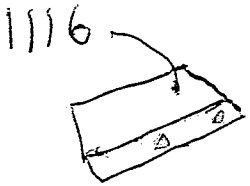

Medicine Cabinet / Door Sensor

- Become alerted if a senior is wandering outside a particular space or community
- Know if senior is eating enough according to schedule by placing on kitchen cabinets
- Monitor medication use by knowing if the pill cabinet is not opened or opened more than expected during the day

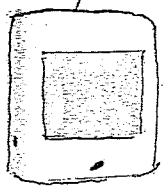

Multi Sensor (Motion & Temperature Sensor)

- Become notified when temperature is above or below a certain range
- Decrease chance of heat stroke or hypothermia

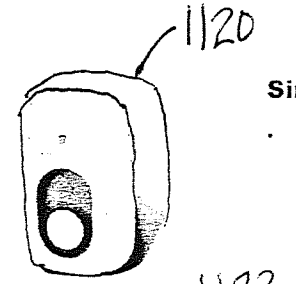

Siren

- Notifies someone in the area with an audible alarm in response to an event as another sensor being triggered

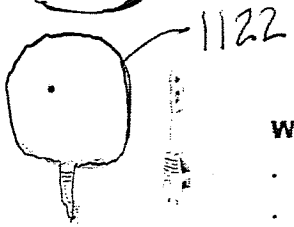

Water Sensor

- Decrease risk of a fall by knowing when bath, toilet, or sink are overflowing
- Useful for bathroom, laundry room, basement, or anywhere that has a potential for a water leak or flooding

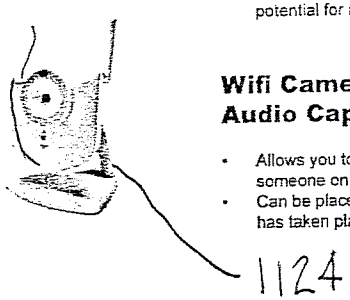

Wifi Camera with Two-Way Audio Capability

- Allows you to hear sound and speak to someone on the other end
- Can be placed at ground level to view if a fall has taken place

Fig. 3

Floor Sensor

Incontinence Sensor

- *With a PERS or other technology, in times of an emergency the button is not necessarily pushed. Seniors many times will not wear nor carry the button around with them. They also take it off for a variety of reasons.*

*Unlike Others:*

- *Nonnatech System is "Hands-free"*
- *Unobtrusive wireless sensors are tied to rules which can notify staff and even family members outside the community if there is irregular activity or inactivity*
- *Lights and small appliances such as stoves, televisions, and lamps can be turned on and off with time parameters that can be set on the private web portal*
- *The system allows staff or family members to become proactive in monitoring potential health related issues, improving the senior's outcome via early intervention.*
- *Most importantly, detects changes in health that can lead to events such as falls instead of only detecting when a fall has taken place*
- *Able to identify changes in ADLs and potential health related problems sooner, reducing accidents and hospital admissions*
- *Monitors temperature changes*
- *Two-Way Audio capability allowing to hear sound and speak on other end*

Fig. 5

HANDS-FREE ASSISTIVE AND PREVENTIVE REMOTE MONITORING SYSTEM

CROSS-REFERENCE TO RELATED APPLICATIONS

The invention described and claimed hereinbelow claims priority under 35 USC §120 from U.S. Provisional Patent Application 61/800,638, filed Mar. 15, 2013, the content of which is incorporated by reference herein.

FIELD OF THE INVENTION

The present invention relates to a hands-free assistive and preventive remote monitoring system for infirm or aged persons or persons with functional impairments or who are chronically ill, without the necessity of body worn transmitter alert devices, without an emergency pendant or any device attached to a person's body. The present invention is also a behavioral remote monitoring solution as well.

BACKGROUND OF THE INVENTION

Emergency pendant and devices that attach to a person's body for detecting, notifying medical and/or rescue services are known.

For example, U.S. Pat. No. 8,279,060 of Liu describes a body attached device which monitors senior citizens by using accelerometers and sensors to detect sudden changes in gait direction and speed (i.e. a sudden fall while walking).

U.S. Pat. No. 7,210,240 B2 of Townsend et al discloses a sensing device attached to a living person to detect body limb and joint motions. U.S. Pat. No. 7,589,637 of Bischoff, et al. discloses a system for monitoring activity of an individual in possession of a body worn "home/away" pendant, where multiple other sensors are used to detect whether the individual is properly using the body worn "home/away" pendant.

The present invention preferably utilizes the Z-Wave protocol to create a local network of a wide variety of special purpose sensors since it has the reliability, low cost, and ease of use required by the task at hand. While others have used Wi-Fi or other IEEE 802.11—based wireless LAN solutions; those are optimized for high bandwidth data flow. The Z-Wave protocol is designed as a low-power wireless technology for transmission of small data packets.

SUMMARY OF THE INVENTION

The present invention overcomes the shortcomings of known arts, such as those mentioned above.

Broadly, the invention provides a hands-free assistive and preventive remote monitoring system for infirm or aged persons or persons with functional impairments or who are chronically ill, without the necessity of body worn transmitter alert devices, such as emergency pendants or any device attached to a person's body. The present invention is also a behavioral remote monitoring solution as well.

As such, the inventive monitoring system prevents falls and other medical catastrophes of infirm or aged persons, or persons with functional impairments or who are chronically ill, through utilization of strategically placed environmental sensors and devices in the infirm or aged person's home, or home of a person with functional impairments or who is chronically ill, (referred to herein at times as the "monitored person"). Preferably, the sensors communicate with each other and are also able to function separately.

In an embodiment, the invention includes a gateway that is accessed remotely and securely via the web from a managing person's (i.e., a manager's) smart phone, tablet, personal computer, or laptop, or any device which has access to the web. The gateway handles communication between these the sensors and/or devices and the inventive application software, which in turn allows the manager to use the application software to receive notifications via e-mail and/or text based on the activity or inactivity of these sensors.

The inventive system is premised on the fact that many seniors and/or medically disabled person living (and aging) in their homes or in senior living communities have routines (monitored persons). During times in which these monitored persons are not going about their normal daily routines, the inventive system can track them including send out notification(s) and/or keeping logs of certain of their activities, which are accessible by the application software and, therefore, enable a manager (such as a caregiver adult child or proxy or a health care provider who manages the health and/or well-being of the monitored person) access to the monitored person's system-tracked behavior. The present invention is used also as a behavioral remote monitoring solution as well for monitoring these persons.

In one method embodiment, the manager accesses the system or the system software enabling him/her to choose which sensor or device (which again, are not required to be worn nor attached to the monitored person's body), that the manager wishes to receive a notification via email and/or text if that device(s) is inactive for number of minutes, even as little as 1 minute. The manager accessing the software can choose if they want to receive these notifications every day of the week or any day of the week, i.e. Monday and Thursday's only. The manager also can choose what time they want to become aware of inactivity of the sensor(s), i.e., between 9:00 am and 10:30 pm. The manager also has a choice of whether or not they want to receive notifications via e-mail and/or text, or just to review the information on their log section at the end of the day, week, or month, and not receive notifications of inactivity.

Other devices in the monitored person's home or personal space in a senior living community also can be activated based on inactivity of the senior or disabled person. For example, if a person enters the bathroom, and there is no activity after a certain amount of minutes (for this example, 20 minutes) in the bathroom, the system can be configured to automatically send a notification(s) to one or multiple persons (managers). Alternatively, or in addition, the system can enable a siren (an audible alarm) in the home, enable or light one or more lamps (a visual alarm) throughout the home to let someone in the home know there is possibly an emergency or an issue such as a fall or, the managed or monitored person's sugar is dropping quickly making them unable to move.

The manager accessing the application software also has the ability to decide and then configure the system as to how much time they want between notifications. For example, if the managing person knows their monitored person (for example, the monitored person is an aging parent) goes to the bathroom every morning by 8:30 am and, if the system identifies (by sensors or devices) that the parent (monitored person) did not enter the bathroom (for this example the door sensor did not activate due to bathroom door not opening) by 8:30 am, the system will automatically send a notification that there is no activity in the bathroom. Of course it is possible that the monitored parent "slept in" and that the manager may want to give the monitored person an extra 15 minutes before they assume that there is a problem leading to the fact that the monitored morning bathroom schedule or routine is off and, call the house, caregiver, emergency personnel etc. To that end, the system allows for the manager to specify and allow 15 minutes to go by before sending out another notification due to inactivity if the parent does not go to the bathroom by 8:45 am.

Many of the devices or mechanisms operate similarly. Preferably, there are a core number of devices that are relied upon including the monitored person's toilet, chair and bed sensors. The system monitors and keeps a log and/or sends out a notification (to the manager) only after there is no pressure detected on a toilet sensor, chair sensor and/or bed sensor for any number of seconds specified by the monitor through use of an interface with the application software.

So for example, a person is sleeping and they have a bed sensor. Many people toss and turn and the weight (partial or full) of the person temporality comes off the bed sensor and back on, the sensor will send out a notification if the person using the software specified to receive a notification when there is activity (for example, significant tossing and turning or up and off movement indicative of a disturbance) detected by the sensor on the bed. With this feature, the application software also enables adding a delay of any number of seconds, for example, 10 seconds. If the monitored person is tossing and turning, they most likely will be fully back on the bed and lying relatively consistently sensor after moving around within a few seconds, which is sensed by the sensor. However if they got off the bed to go to the bathroom in the middle of the night (sensed by the bed sensor), the caregiver won't receive a notification until the monitored person gets back into bed after using the bathroom, assuming their bathroom visit was longer than 10 seconds.

There are specific benefits and advantages realized by the system. For example, the system helps caregivers in (or outside) of homes of the monitored person or, in, proximate or outside the monitored person's spaces in senior living communities become proactive in monitoring potential health and/or wellness-related issues, improving the monitored person's/resident's outcome via early intervention.

Wellness-related issues might include medication side effects, where the application software enables a manager use of active and inactive features such as door or window sensors, medicine cabinet sensor or even a Wi-Fi camera. By reviewing the data, either in real time or stored (post occurrence), a managing caregiver can know if the monitored person is or is not taking their medication according to schedule. This sensor is placed in the area where the medication is stored, and if there is no activity, it could mean the person is not taking their medication, or if there is too much activity meaning the sensor is activated frequently, it could mean the person is taking too much medication. Both scenarios could cause problems for the person required to take the medication.

In addition, other side effects might occur surrounding the monitored person's medication, such as lack of energy, which might be indicated by the monitored person spending too much time in a specific area of the home or not going about their daily routine. Drowsiness/sleeping too much, (i.e., indicated by observing or sensing that the monitored person is spending too much time in the bed), sleep problems, such as insomnia, indicated by no activity or very little activity noticed in the bed could be a medication-related side effect. Also, fainting might be indicated where the monitored person (is detected to) display no activity in any areas of the home after a certain amount of time. Too much or too little of an appetite may be indicated through detection of too much or too little activity in food pantries, kitchen cabinets, and refrigerators. Likewise, thirst might be indicated by detecting that the monitored person is going into kitchen (or fridge) and drinking more than usual. Upset stomach/vomiting/diarrhea might be indicated by detecting a lot of time the monitored person is spending in the bathroom specifically on the toilet. A sudden change in vision (e.g., person can't see and has an accident allowing system to realize there is no movement could be detected). Determining whether the monitored person is too cold or too hot might be indicated if the sensor determines the monitored person changes temperature in the home, which goes above or below a certain threshold. This change in temperature is detected by a temperature sensor. Using features of the application software and monitored devices and sensors enables the manager of the monitored person to become aware of these issues before too much time goes by and things get out of hand.

For that matter, the inventive system and application software enables monitoring the effects of a urinary tract infection (UTI) in the monitored person. For example, using a toilet sensor, the system and, therefore, the monitoring caregiver or manager realizes that the frequency of a person's bathroom visits, specifically the increase in the use of the toilet/commode, indicate a UTI or another issue such as a side effect to a medication. The system and application software decides that there could be a UTI by keeping logs that the manager can review to see the change in pattern as well be able to determine if there is a problem based on the number of notifications they receive.

The inventive system also monitors activities of daily living, for example, the sleeping patterns of the monitored person. This is carried out using an activity and inactivity monitoring feature of the application software in cooperation with a bed sensor and/or a Wi-Fi camera. Through access to same, the monitoring caregiver can become aware of how often the monitored person is sleeping. Knowing how much the monitored person is sleeping allows the manager (caregiver, family member, staff member, professional) to become aware of depression. Lack of energy and sleeping too much or too little (insomnia) are symptoms of depression and can be identified from using Applicant's system. This information is also kept in the software's logs for review on a daily, weekly, monthly, or yearly basis.

Moreover, by using a bed/chair/toilet Plugin, the manager doing the monitoring can determine how well the person is sleeping on the 1$^{st}$ page. This information is also kept in the software's logs for review on a daily, weekly, monthly, or yearly basis.

Moreover, by using the activity and inactivity monitoring features of the application software in cooperation with a motion sensor and/or kitchen cabinet sensor and/or refrigerator door sensor, a monitoring caregiver can become aware of how often a person is eating and if they are eating according to schedule. The monitoring or managing caregiver also could determine if a monitored person is eating too little, which could also cause problems such as a fall. This information is also kept in the software's logs for review on a daily, weekly, monthly, or yearly basis.

Moreover, by using the activity and inactivity monitoring features of the application software in cooperation with the toilet sensors and/or motion sensors and/or door/window sensors, the monitoring caregiver can become aware of the frequency of a person's bathroom visits and the time of day the person is making these visits. If it is during the night, the monitoring caregiver can add applicant's lamp controller to the controlled devices and control same to have lights turn on when a person is moving around at night. If person is frail, it could be good idea to add a live in caregiver to assist at night if family or professional caregiver is unaware of the nighttime bathroom use. This information is also kept in the software's logs for review on a daily, weekly, monthly, or yearly basis.

Moreover, by using the activity and inactivity monitoring features of the application software in cooperation with the door/window sensor and/or Wi-Fi camera and/or motion sensor and/or chair sensor and/or bed sensor, the monitoring caregiver can become aware how often the monitored person in the home is leaving the home according to schedule for a variety of reasons, such as meeting a friend, going to the park, going to the doctor, etc. Having social activities is important to the health of the senior as well. If the monitored person is sedentary, the application software and system would inform the monitoring caregiver if this is the case. This information is also kept in the software's logs for review on a daily, weekly, monthly, or yearly basis.

Fall Prevention and Detection is a very advantageous feature of the invention. As is known, there are many reasons why a person might fall. For example, an elderly or frail person might slip on something on the floor or they might have a chemical or medicine imbalance. As stated earlier, the inventive system helps a monitoring caregiver to know if there are any indications that a fall might happen. Of course, the system and application software is not able to prevent falls simply by monitoring the person's activities (e.g., the monitored person tripping or slipping on an item on the floor), but can help avoiding such mishaps before they occur by obviating conditions that might lead up to a fall or slip. For example, the invention helps by making sure that lamps are on when moving around in the home.

Many falls happen when a person is getting out of bed too quickly or needing to move around at night possibly having to go the bathroom. With the inventive application software in cooperation with a power controller, such as a lamp sensor, the system can have lamps turn on and stay on for as long as specified by the application software. This sensor can be turned on when any of other sensors are activated by the system. For example, if a monitored senior gets up out of bed at 1 am to go get a glass of water or to go to the bathroom. As soon as the motion sensor near the bed detects movement, a lamp can turn on. If the monitored person is not supposed to get out of bed on their own, a siren can turn on notifying someone in the home as well as automatic email notifications and/or texts. The inventive system helps in detecting changes in health that can lead to falls instead of only detecting when a fall has taken place.

In greater detail, the system helps detect a fall because sensors positioned about the monitored person's premises and living area detect when the monitored person has entered a specific area. For that matter, when there is no movement for a specified amount of time (i.e. 15, 20, 30 minutes, etc.) a siren can go on notifying someone in the home and/or notifications and go out via e-mail and/or text. For example, where a monitored senior goes to the bathroom, and after 15 minutes if no activity is detected in the shower/bath, faucet or toilet, this could indicate there has been a fall or an accident. The inventive system also allows residents to be free of anything to wear around their necks, wrists, or ankles. A combination of the application software and a water sensor and/or motion sensor and/or toilet sensor helps in the detection.

Moreover, the system and application software helps in prevention and detection of wandering. By using by using the activity and inactivity monitoring features of the application software in cooperation with several sensors, the remote monitoring allows the managing caregivers and staff to set rules for family members and residents to notify them of wandering outside a particular area of their space or community.

Other benefits of the inventive system and application software include that lights and small appliances can be turned on and off with time parameters that can be set inside or outside the monitored persons room or home. These appliances can also be controlled by the use of other devices in the system, such as sitting in a chair, opening a door, or getting out of bed in the middle of the night.

In one embodiment, the invention provides a hands-free assistive and preventive remote monitoring system. The system comprises at least one sensor network comprising a plurality of sensors dispersed in a living environment of an infirm or aged person, or a person with functional impairments or who is chronically ill, a gateway connected to each of the at least one sensor network and configured to route communications to and from the sensor network, including emails, text messages and signals where necessary directly to one or more sensors and a server configured to manage the sensor network and the communications, including receiving the communications from the sensor network and sending the communications and control signals to the gateway or sensors in the at least one sensor network to enable access to sensor data and to control operation of the sensors by a variety of support personnel, wherein the communications include data on a state of the infirm or aged person, or person with functional impairments or who is chronically ill, in the living environment.

The gateway operates according to a short-range wireless protocol optimized for reliable, low-latency communications of small data packets, wherein the short range wireless protocol is Z-Wave. The support personnel are any of the group consisting essentially of medical professionals, caregivers, 24-hour monitoring employees, family members and neighbors.

The server processes the sensor data to monitor the activities of the aged or infirm person, or person with functional impairments or who is chronically ill, at the living environment in accordance with a set of rules. The processing includes relaying sensor-detected events to appropriate support personnel based on custom alerts related to pre-defined alert reception schedules for the support personnel entered through the server. The server provides a user interface object to an electronic processing device associated to the support personnel that enables the support personnel to define rules for sensor operation. The user interface enables the support personnel to access and control the sensors and to view the sensor data in real time.

Preferably, the server is programmed to analyze activity of the aged or infirm person, or person with functional impairments or who is chronically ill, and the living environment, to characterize detected activity and environmental conditions as events and to respond to the events. The server notifies the support personal of the events and, the server notifies any of police-related emergency service providers, fire-related emergency service providers and first responder medical service providers.

In another embodiment, the invention provides a computer-based method of monitoring a state of a person in a living space or the state of the living space to optimize the monitored person's well-being. The method comprises arranging a plurality of sensors in predetermined positions within the living space for generating sensor data, connecting each of the sensors to a gateway node in the living space, the gateway node configured for routing signals to and from the sensors in the sensor network and operating a server including a processor and a memory that is programmed to communicate with the gateway node to control the sensors, receive data detected by the sensors, to process the sensor data received from the sensor network and to generate communications based on the processing in accordance with a set of rules.

The step of operating preferably includes controlling one or more of the sensors according to one or more of a set of rules, wherein the one or more of the set of rules define events at the particular sensor. The step of operating also includes responding to event-driven signals sent from the gateway node and notifying support personnel in response to processing received event-driven signals sent from the gateway node. Most preferably, the step of operating includes providing a web portals for access by support personnel, the web portals associated to one monitored person or one living community housing at least one monitored person. The web portal is provided in a form of a user interface. In one form, the method includes that one of the sensors is a camera that provides video data from the living space and wherein the web portal enables the support personnel to view the living space thereby.

The invention also may embody a computer program product having program code means that are stored in memory on a non-transitory computer-readable data carrier, for performing one or more of the aforementioned steps when the program code means is executed on the processor or like processing unit.

BRIEF DESCRIPTION OF THE DRAWINGS

Further features and advantages of the invention will become apparent from the description of embodiments that follows, with reference to the attached figures, wherein:

FIG. 3 presents a perspective or top view of 6 additional sensors that could be used with the inventive system;

FIG. 5 depicts a list of the system capabilities of this invention.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
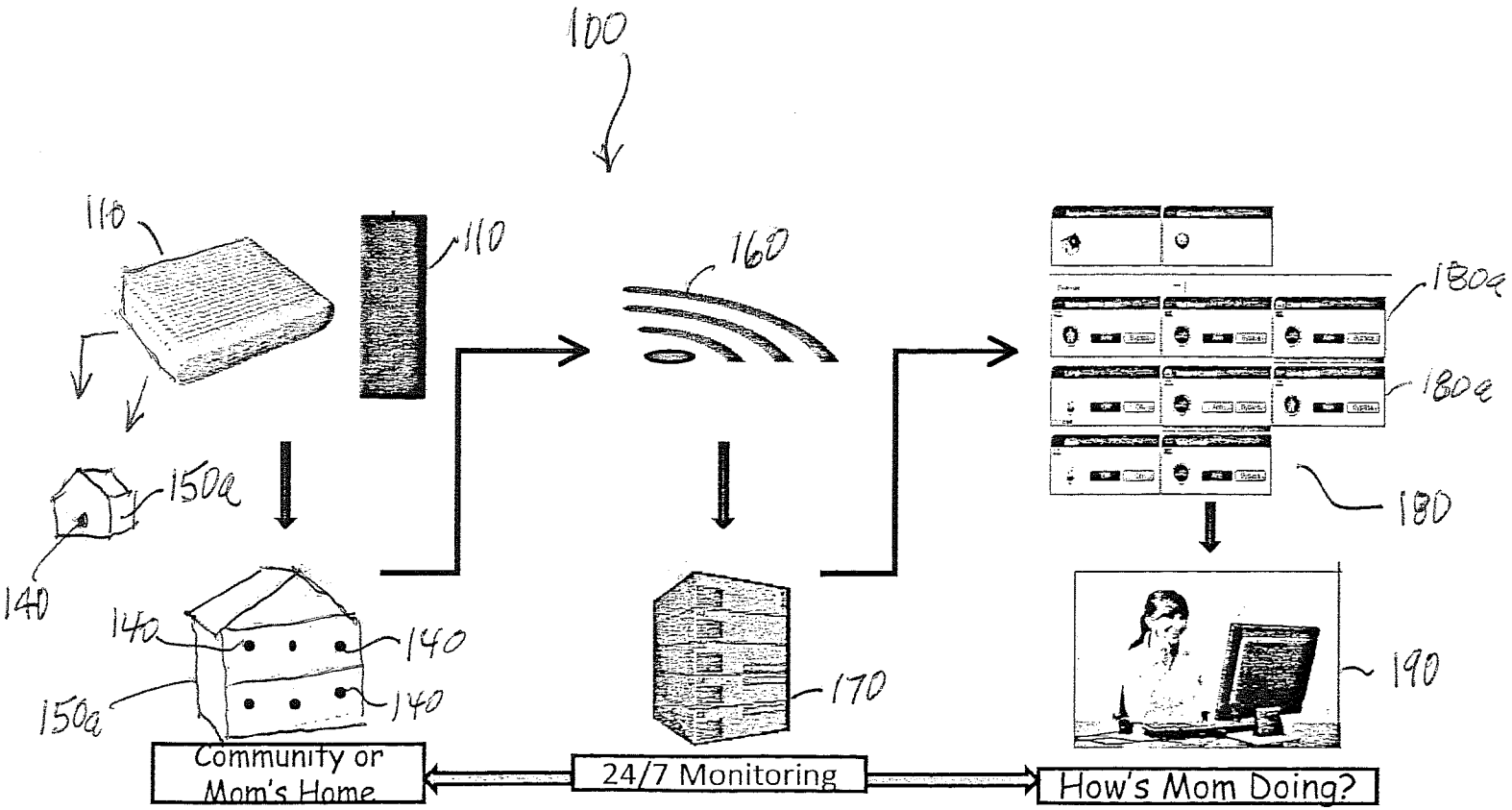
FIG. 1 shows a block diagram representing one system embodiment of the invention.

FIG. 1 presents a schematic showing a high level block diagram of the monitoring system 100 of this invention. The system 100 is comprised of a number of sensors 110 placed throughout a home 150*a* or elder living community 150*b* in which a person or, persons to be monitored, live individually or collectively. The sensors 110 are part of a network of sensors, which each sensor communicates wirelessly or by wired connection, to sensor network nodes 140 located at the home 150*a* or community 150*b*. The nodes 140, sometimes referred to as gateway nodes, communicate wirelessly or via telephone or cable networks (i.e., the Internet) 160 to a server 170. The server 170 links or communicates the data collected at the individual or community nodes 140 and presents same in the form of a number of web portals 180 presenting screen shots 180*a*. Managing or monitoring persons (for example, support personnel, family members, etc.) can communicate with the server 170/web portals 180 through various electronic devices 190. That is, caregivers log on to a private web portal and set up custom alerts, custom notifications schemes and views in video or snapshots of the monitored persons or monitored homes/elder living community. The server 170 is a secure data server.

Figure 2:
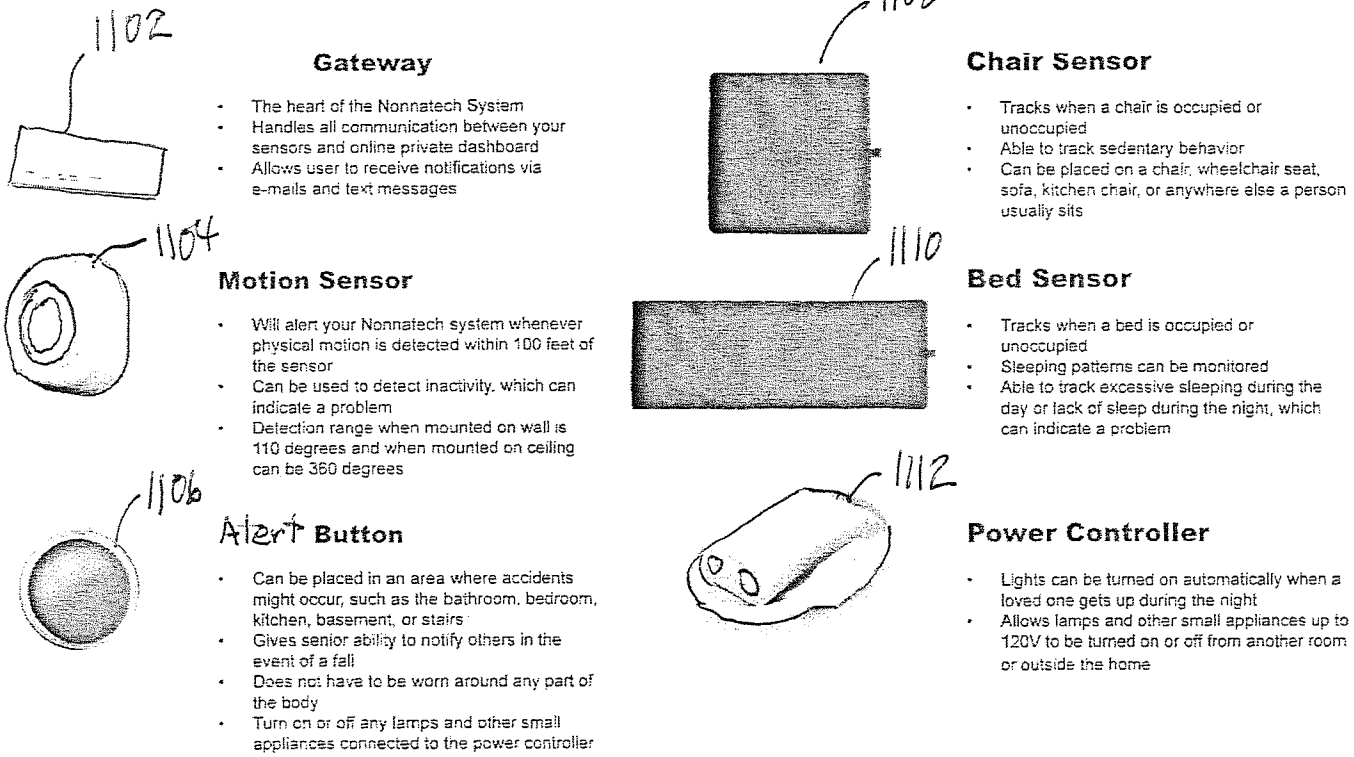
FIG. 2 presents a perspective or top view of 6 different sensors that could be used with the inventive system.

FIG. 2 shows a variety of sensors 110 and a sensor controller or gateway 1102. The gateway 1102 is the heart of the each node 140 (i.e., gateway node) within the system 100. The gateway 1102 for each node 140 communicates with all of the sensors on a local wireless basis using Z-Wave protocol and at the same time establishes a path to and from the Internet/phone/satellite 160 for external communications to the server 170. The sensors 110 are able to work with any Z-Wave device e.g. lights, appliances, thermostats, etc. Sensors may include a motion sensor 1104 detects motion within 100 feet. When mounted on a wall a detection angle is approximately 110 degrees. When mounted on a ceiling, a detection angle is approximately 360 degrees laterally. An alert button 1106 can be placed in dangerous areas (i.e., dangerous to the monitored person meaning areas where accidents or injuries are likely to occur), such as bathroom or stairs, for emergency use by the monitored person. Alert buttons 1106 also may be used to control lamps or small appliances connected to power controllers 1112, where the alert button communicates with the power controller. Chair sensor 1108 tracks occupancy of a chair or sitting area in order to help track sedentary behavior. Bed sensor 1110 tracks when a bed is occupied or unoccupied and is therefore key to monitoring sleep patterns in a non-obtrusive manner. Power controller 1112 is used to activate (on/off) and control lamps or small appliances (brightness, time periods, etc.) from one to another room or even from outside the home.

FIG. 3 shows additional sensors 110. Toilet sensor 1114 is positioned in a bathroom and is actuated thereafter with every visit by the monitoring person to the bathroom. Toilet sensor 1114 is water resistant and can be covered with a toilet mat so that the toilet sensor 1114 is not readily apparent. Medicine cabinet/door sensor 1116 can be used on bathroom doors, bathroom cabinets, kitchen cabinets or even drawers. Multi-sensor 1118 is a motion sensor (like sensor 1104) and is preferably combined with a temperature sensor, which is key to decreasing the chance of heat stroke or hypothermia. Siren 1120 notifies someone in the area with an audible alarm in the event another particular sensor is triggered. Water sensor 1122 detects water leakage or flooding. Wifi camera with 2-way audio 1124 is a multifaceted data gathering device that can be placed at ground level to view certain locations with falls likely take place, or where monitored persons must pass to carry out daily or nightly activities. Note that all sensors have a Z-Wave communications capability to communicate to the gateway 1102. Also, note that alert button 1106, chair sensor 1108, bed sensor 1110, toilet sensor 1114, door sensor 1116, and water sensor 1122 are two-state contact-closure type units which signal the gateway 1102 any state transition in either direction.

While other sensors 110 may be used, a typical example of the toilet sensor 1114 is that manufactured by Recora, Inc., under the Telehealth Sensors brand, which is a substrate of about 24 inches by 21 inches with an activation force of 10 lbs. and a contact closure of a normally open, momentary contact switch. The toilet sensor 1114 has a maximum current of 50 mA and a maximum voltage of 24 volts. The toilet sensor 1114 is installed in front of the toilet, with ears extending on each side of the toilet base. Recora Inc. also manufactures a typical alert button, such as alert button 124.

A typical example of the chair sensor 126 includes a sensor manufactured by Recora, Inc. under the Telehealth Sensors brand, which is a substrate of about 11 inches by 11 inches with an activation force of 50 lbs. and an interface of a normally open, momentary contact switch. The toilet sensor has a maximum current of 50 mA and a maximum voltage of 24 volts and, is installed on the center of a chair seat.

A typical example of the toilet sensor 132 is that manufactured by Recora, Inc. under the Telehealth Sensors brand, which is a substrate of about 24 inches by 21 inches with an activation force of 10 lbs. and a contact closure of a normally open, momentary contact switch. The toilet sensor has a maximum current of 50 mA and a maximum voltage of 24 volts. It is installed in front of the toiler, with ears extending on each side of the toilet base.

Motion sensor 1104 is typically that made by Everspring, Inc. or by Aeon Labs. The power controller 1112 also is typically manufactured by Aeon Labs. The siren 1120 and water sensor 1122 are typically manufactured by Everspring, Inc. The multi-sensor 1118 can be that manufactured by Everspring, Inc. and/or Aeon Labs.

A typical medicine cabinet/kitchen cabinet/door/window sensor 1146 is typically manufactured by Aeon Labs.

The communicating gateway 1102 is typically manufactured by Vera Control, Ltd. formerly known as MiCasaVerde, e.g., HAI 97A00-1 KNX Gateway, which allows controllers to communicate with environmental sensors installed on a network in a home. Other similar gateways may be used.

Vera Control, Ltd. formerly known as MiCasaVerde, also manufactures a surveillance camera with 2-way audio 142 that can be used (as camera 1124) with the monitored person's home 150*a* or community 150*b*.

Figure 4:
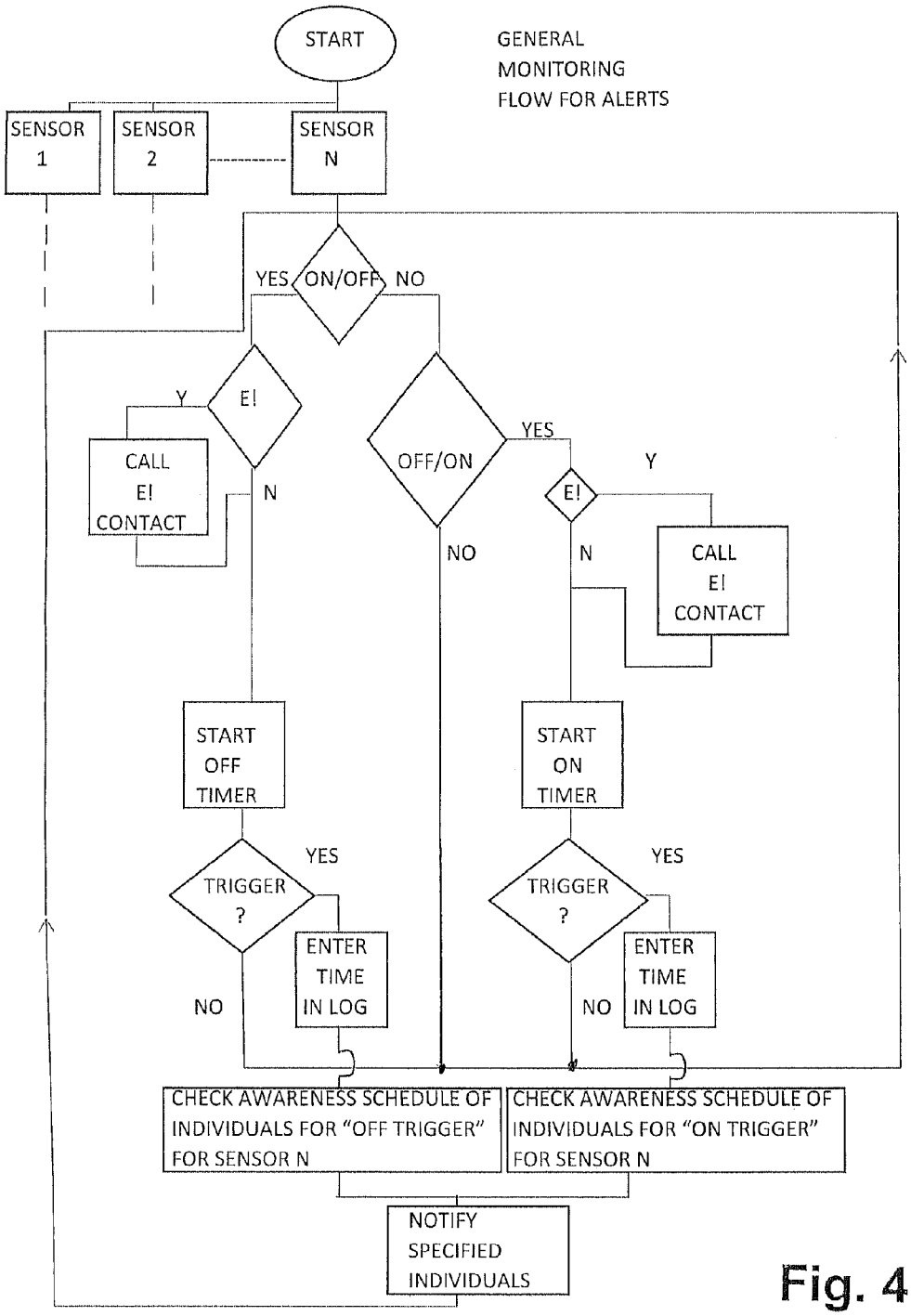
FIG. 4 presents a high level flow chart of general sensor monitoring to create alert events according to the inventive principles.

FIG. 4 is a high level flow chart for general sensor monitoring for monitoring system 100, which lead to alert generation and notification of proper individuals to respond. Each of the on/off type sensors 110 such as button sensor 1106, chair sensor 1108, bed sensor 1110, toilet sensor 1114, door sensor 1116, and water sensor 1122 have a similar flow. Both ON to OFF as well as OFF to ON transitions are timed separately as they may indicate separate alert situations with different trigger thresholds. Some sensor transitions may indicate an immediate emergency (E!) alert situation which would result in immediately calling an emergency response contact.

Trigger events are entered into a log even if they do not lead to major alerts. Multiple triggers (not shown) can be used to denote escalating or unique events. Once an event is logged for a sensor, the awareness schedule and method of contact for each individual associated with the sensor is checked. That is, an email alert is not just sent to the server, but could be sent directly to police, first responders, doctors, firemen or other appropriate individuals for contact after these "filters" are applied. Filters can be applied at the node (e.g., the gateway of at the server).

Note that ON to OFF transitions and associated timings are much used in an analysis of INACTIVITY as described in the summary section. Also, more intricate linked sensor events can be programmed to log events that can be used to great advantage in diagnosing underlying problems such as medication side-effects or urinary tract infections. Although much of the suite of software algorithms can be standard code, individualized code specific to monitored individuals with unusual circumstances can be programmed. Timer trigger points are often set according to individual patterns of behavior. The code or software application comprising the inventive method shown in the FIG. 4 flowchart may reside in a memory in the gateway, or in a memory in the server. As such, inventive processing may occur at the gateway node or at the server. For that matter, the application software of program comprises a set of computer readable instructions that may be stored on a non-transitory computer-readable medium and upon downloading and operation by a processor at the gateway, at the server, or at some other microprocessor based control device, executes the inventive method electronically.

Figure 4A:
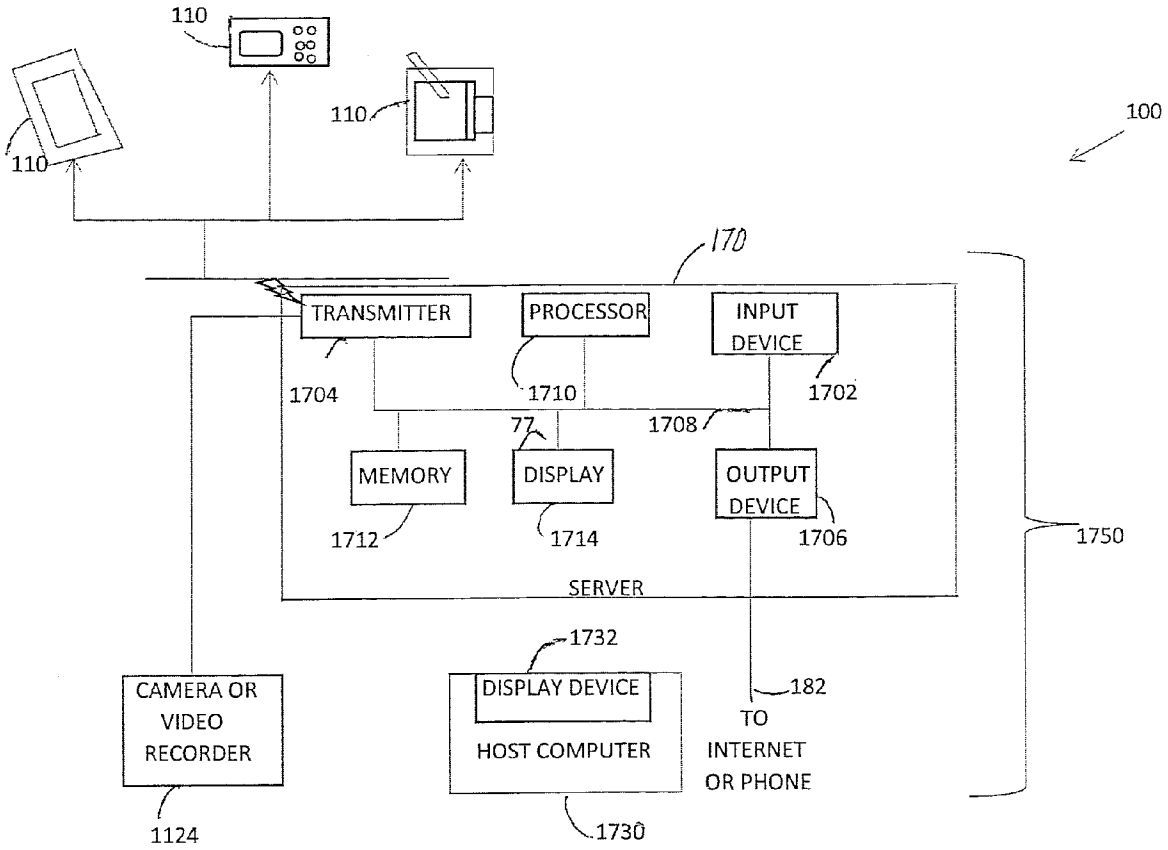
FIG. 4A shows a block diagram depicting a server of the monitoring authority that is programmed or configured with the application program or software that operates to carry out the inventive method.

FIG. 4A depicts one embodiment of a server 170 that is programmed to function according to the invention. FIG. 4A depicts a monitoring management system for a web-based browser 182 used by monitor center 1750 with the sensors 110 within the home 150*a* or community 150*b* of an aged or infirm person, or person with functional impairments or who is chronically ill, according to a system 100 of the invention. For example, FIG. 4A presents a simplified block diagram of a one embodiment of monitor center 1750's server 170. Server 170 includes an input device 1702 such as a mouse, keyboard, USB connector/port, pen device, etc., as a transmitter 1704 to wirelessly transmit and receive communications, including environmental and locational data from sensors 110, as well as audio and/or video surveillance data from camera 1124 with video and audio capabilities, to and from the sensors 110 and, to transmit commands to and from the monitoring command post. Output device or function 1706 connects the server 170 to the Internet or satellite phone system, as known to those of ordinary skill in the art. Conventional bus 1708 connects the transmitter 1704, the input device 1702 and the output device 1706 to a processor 1710, a memory device 1712, a display device 1714 (including an audio component not shown).

The processor 1710 may include a special purpose processor configured to perform the processes described herein. In another embodiment, the processor 1710 is a general purpose processor configured to execute computer executable instructions (e.g., stored in the memory device 1712) to perform the processes described herein. In addition, or in other embodiments, the processor 1710 may be connected to a host computer 1730 of monitor center 1750 having a display device 1732. The host computer 1730 may include computer executable instructions for performing the processes described herein. The host computer 1730 may be used in certain embodiments.

As also shown in FIG. 4A, the management software of monitor center 1750 is based off a web-browser 182 that links into the specific sensors 110 and audio/video surveillance camera 1124 in the home of the infirm or aged person, or person with functional impairments or who is chronically ill. In the web-browser 182 there are individual events created and the operator uploads environmental and locational data from sensors 110, and/or video and/or audio from camera 1124, to the support personnel on their respective computers or other electronic devices.

Figure 4B:
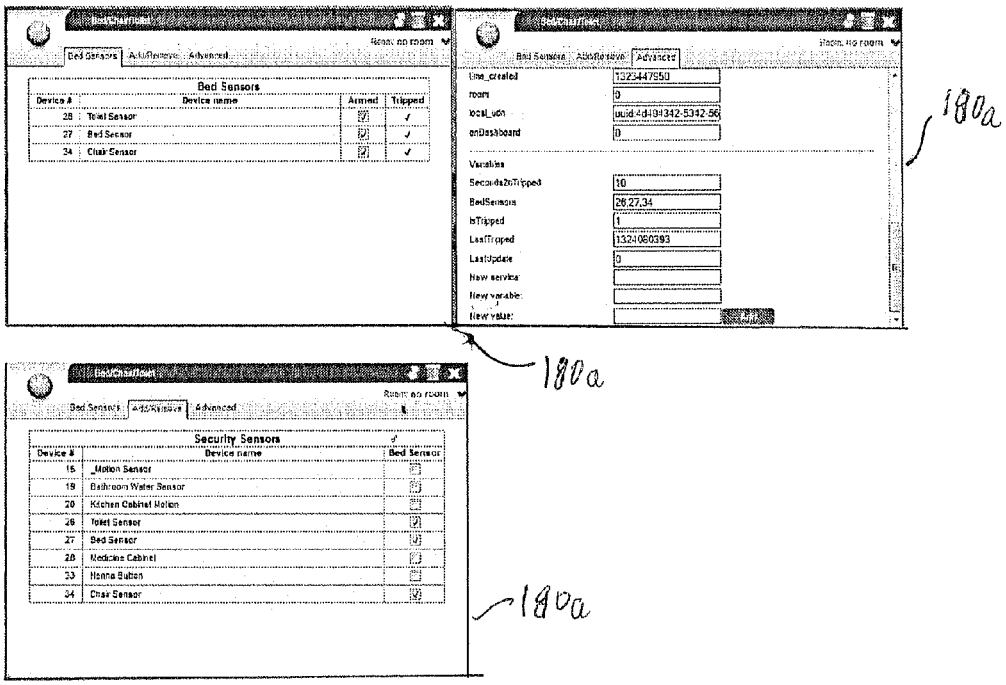
FIG. 4B presents a screen shot of a computer display web portals 180 which communicate with support personnel for inventive operation.
Figure 4C:
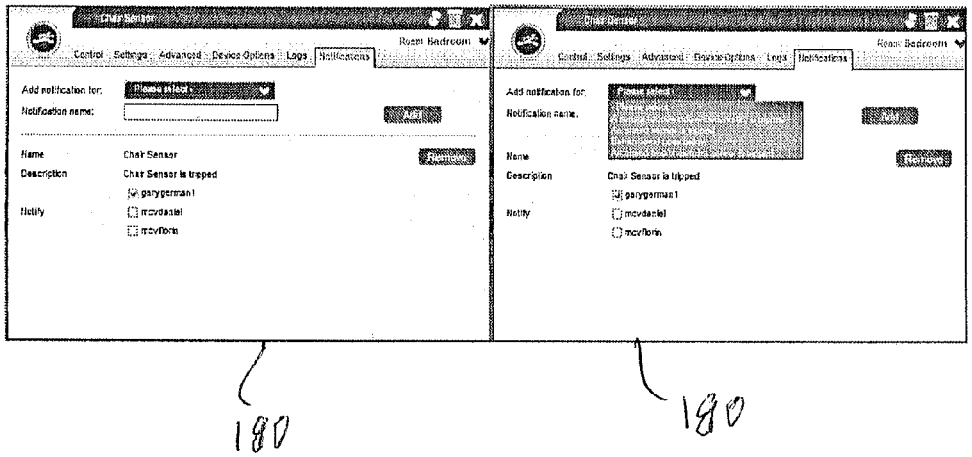
FIG. 4C presents a screen shot of a computer display web portals 180 which communicate with support personnel for inventive operation.

Data is downloaded from the browser 182 and displayed as web portal screen shots 180*a* on displays shown in FIGS. 1, 4B and 4C to the support personnel, on the screen of each support personnel's computer or other electronic device. The data that passes through each computer or electronic device logs on the web browser 182 so that the support personnel overseeing each event can login and view a list of any information from monitor center 1750 on web portals 180 sent from the computer of monitor center 1750 (email, print commands, messages, etc.), such as shown in the screen shots 180*a* of FIGS. 1, 4B and 4C.

In one embodiment, in this information management process, the operator behind the scenes at monitor center 1750 controls the information going to the computer interface by utilizing web-based browser 182, which is a software program that allows the user to find and read encoded documents, in a form suitable for display upon computers with displays for information 110 to the support personnel, in conjunction with the Internet 160.

Figure 4D:
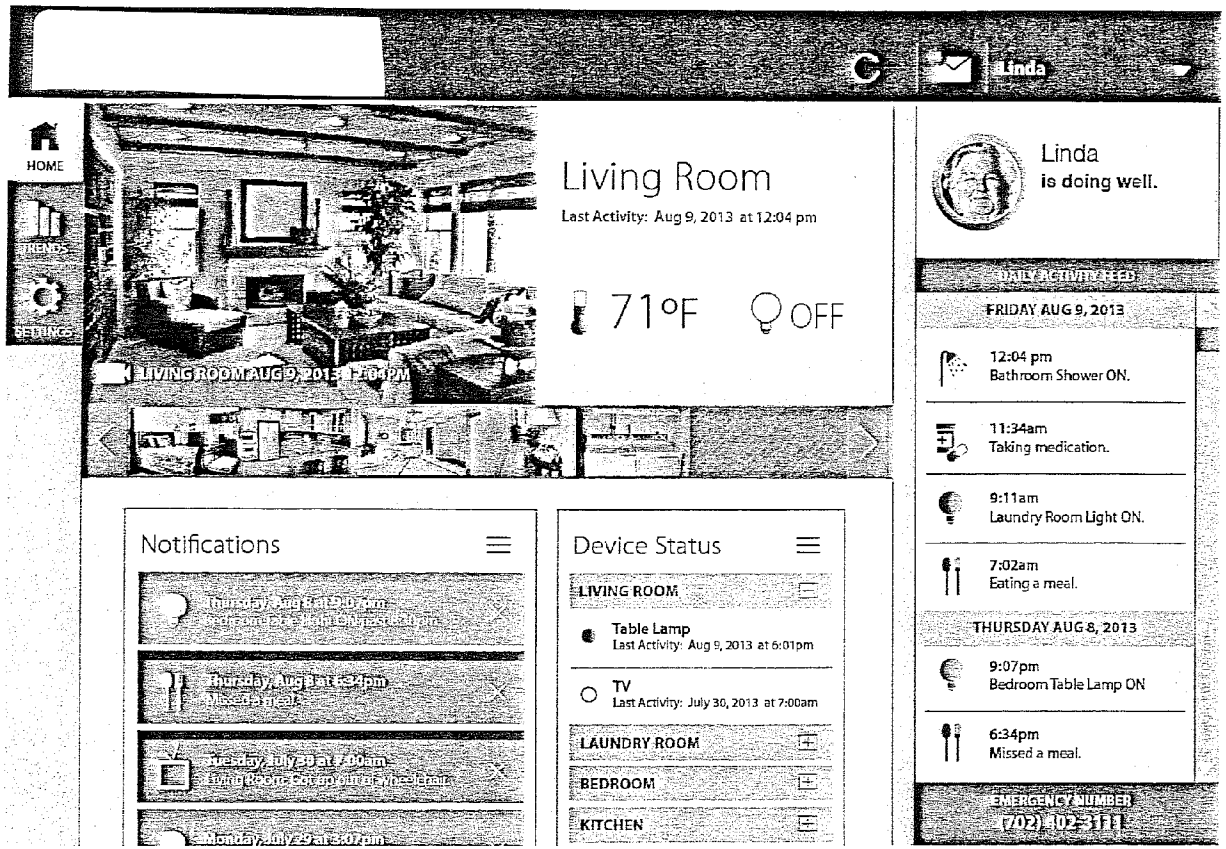
FIG. 4D presents a screen shot of a GUI presented to the monitoring or managing person when user is doing well.
Figure 4E:
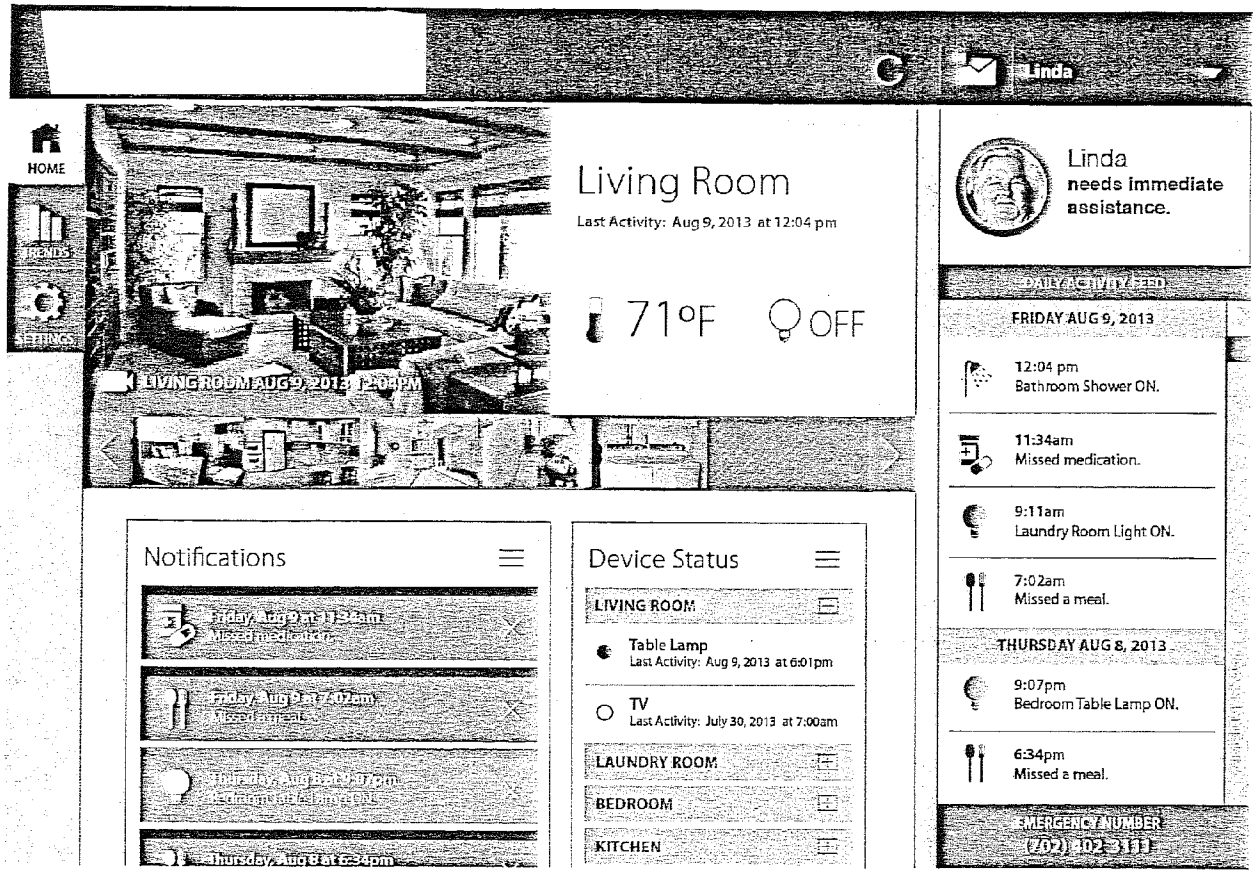
FIG. 4E presents a screen shot of a GUI presented to the monitoring or managing person when user needs assistance.
Figure 4F:
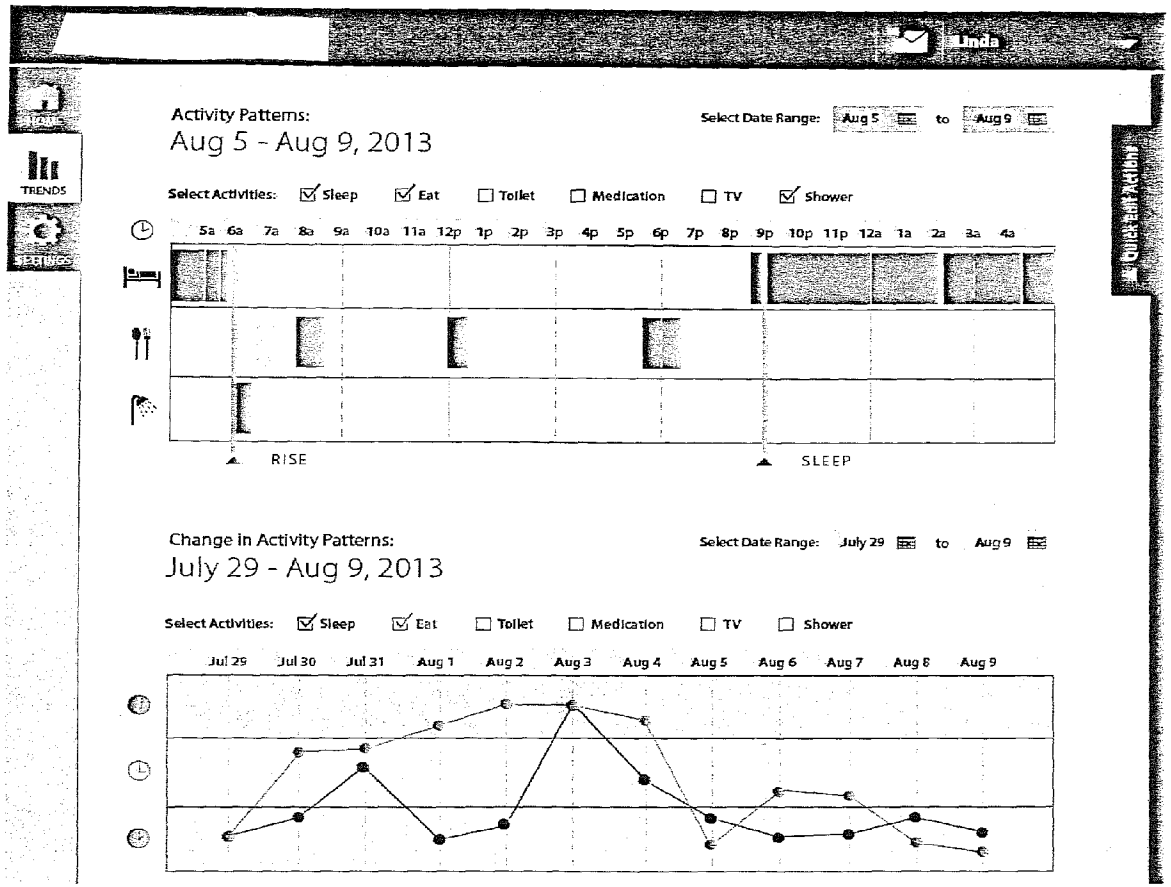
FIG. 4F presents a screen shot of a GUI presented to the monitoring or managing person that shows a plan for the monitored person and the data for same over time, including hourly at the top and daily, weekly and monthly at the bottom.
Figure 4G:
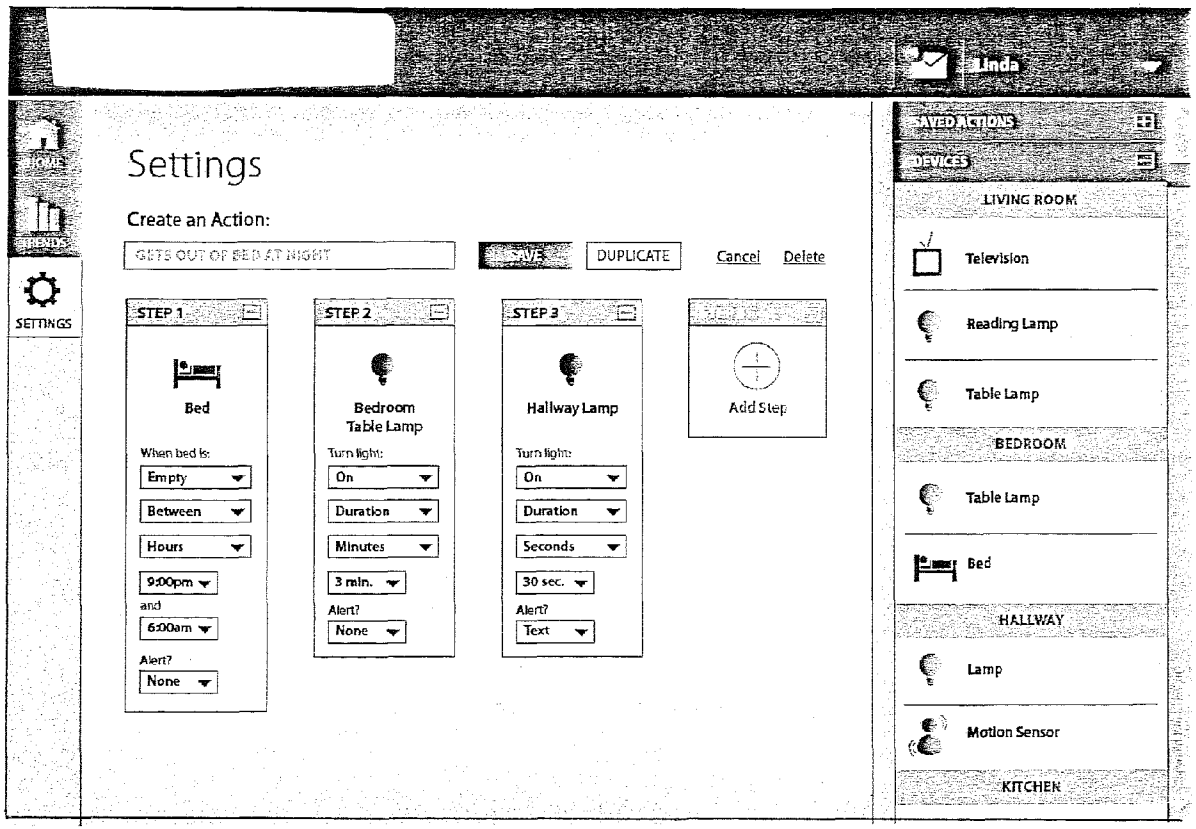
FIG. 4G presents a screen shot of a GUI presented to the monitoring or managing person to enable creating scenes/rules and changing settings.
Figure 4H:
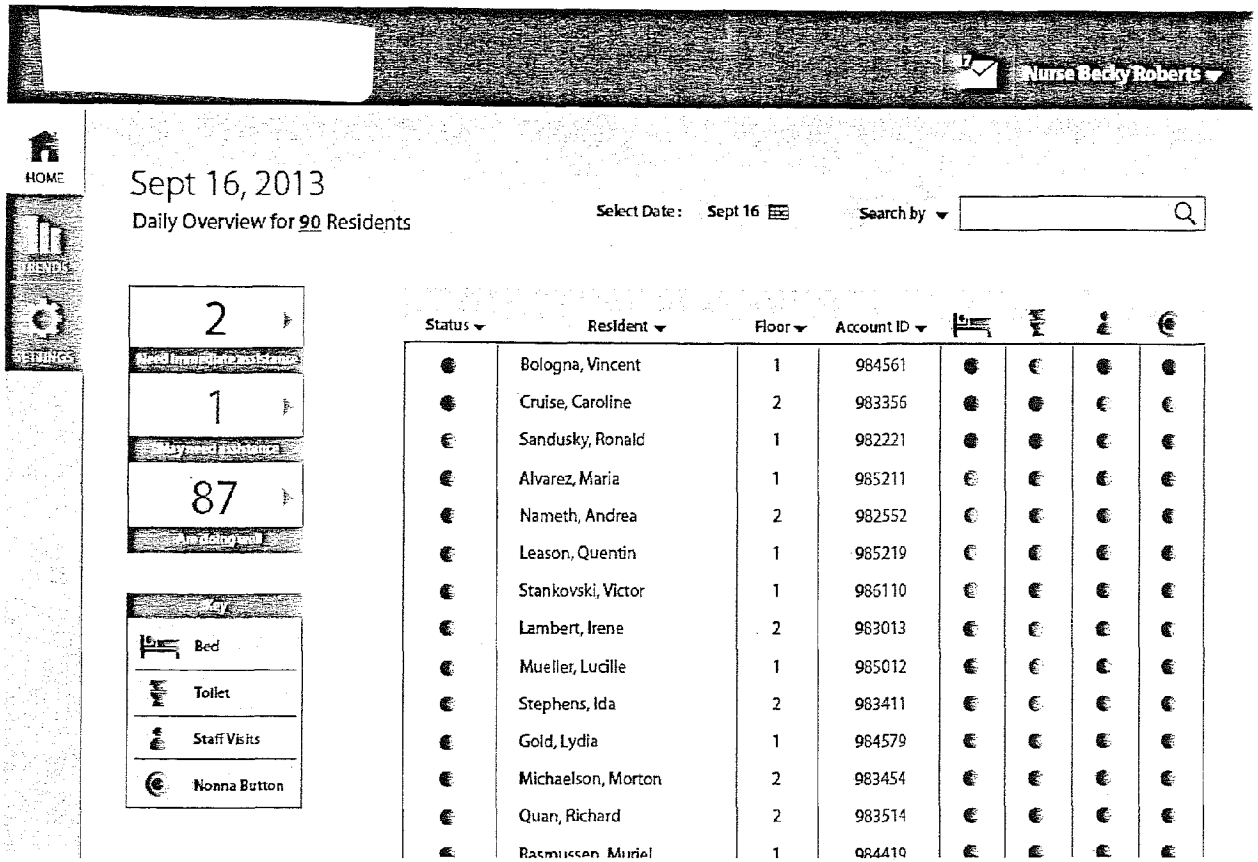
FIG. 4H presents a screen shot of a GUI presented to the monitoring or managing person highlighting multiple persons for monitoring resident in a senior living community.
Figure 4I:
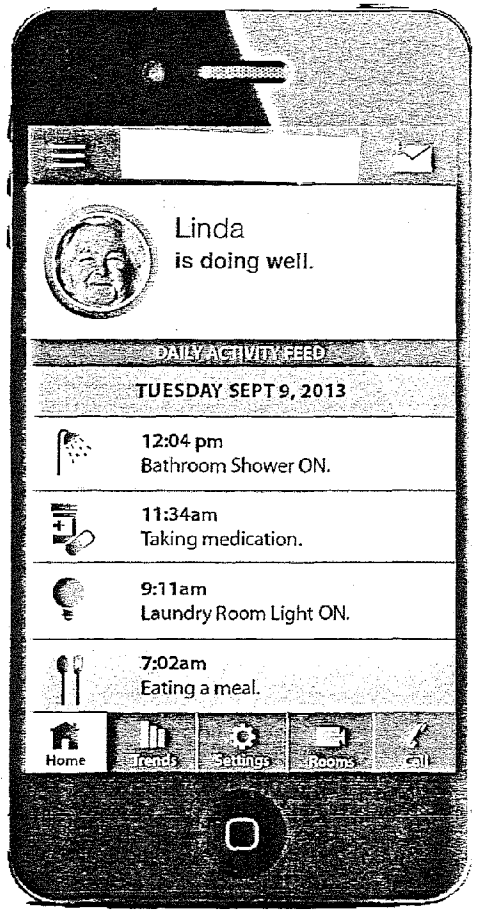
FIG. 4I presents a screen shot of a GUI presented on a cell phone to the monitoring or managing person when a monitored person user is doing well.
Figure 4J:
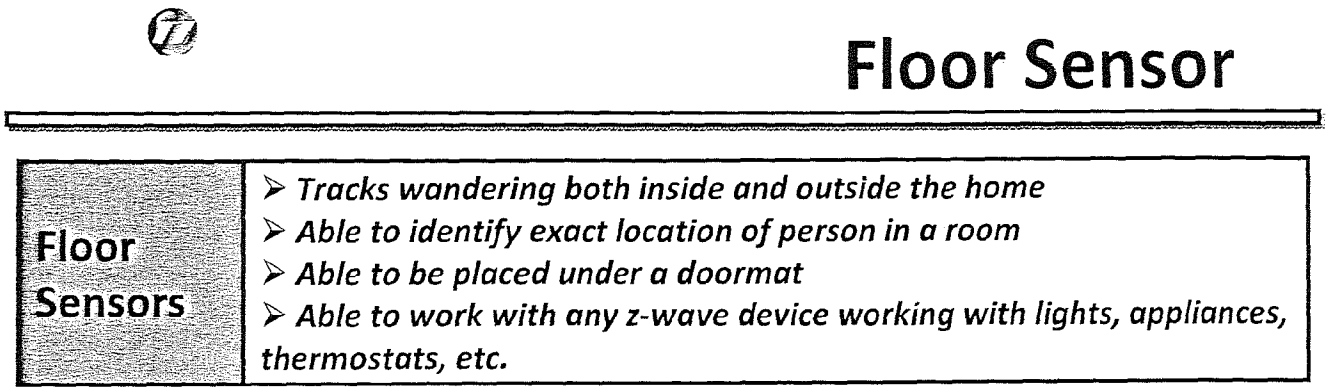
FIG. 4J presents a screen shot of a GUI presented to the monitoring or managing person regarding a floor sensor.
Figure 4K:
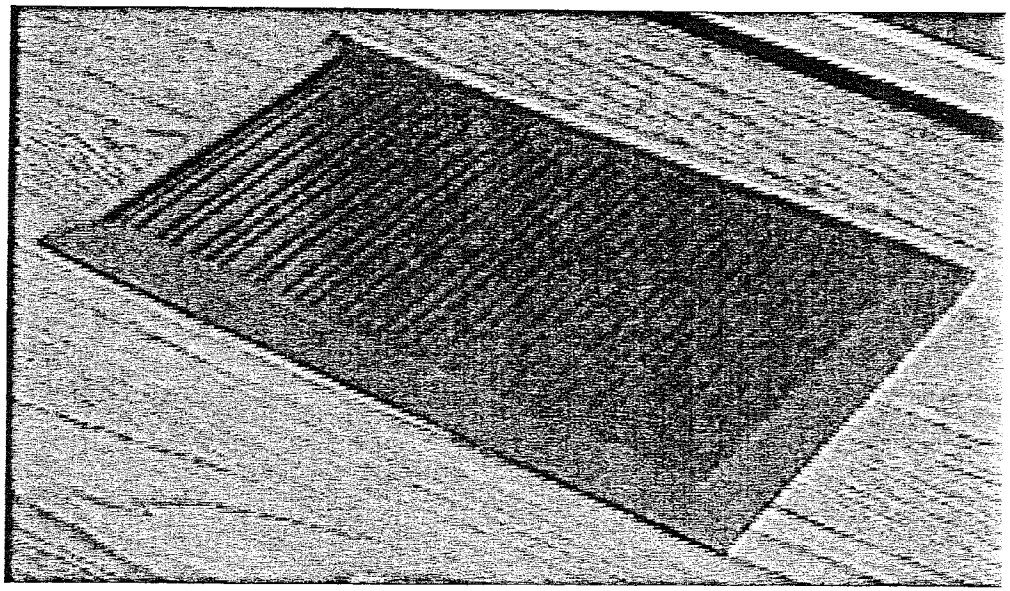
FIG. 4K presents a photograph of a floor sensor used with the invention.
Figure 4L:
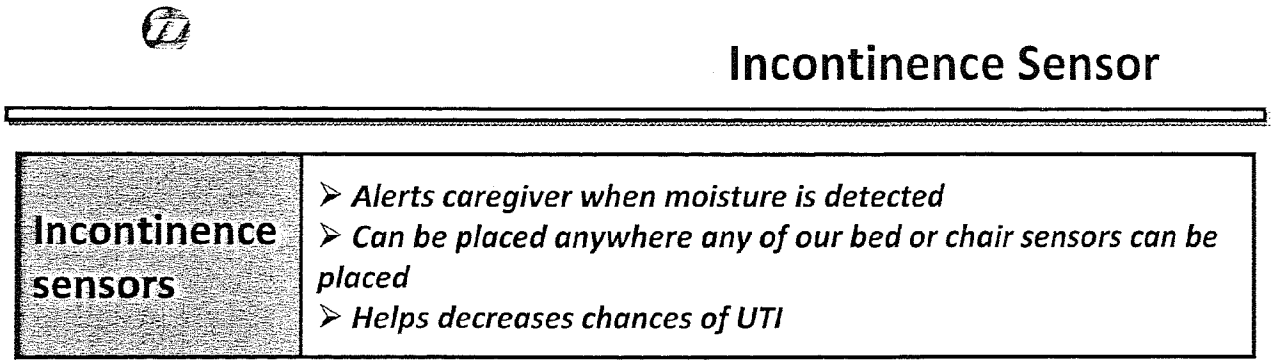
FIG. 4L presents a screen shot of a GUI presented to the monitoring or managing person regarding an incontinence sensor.
Figure 4M:
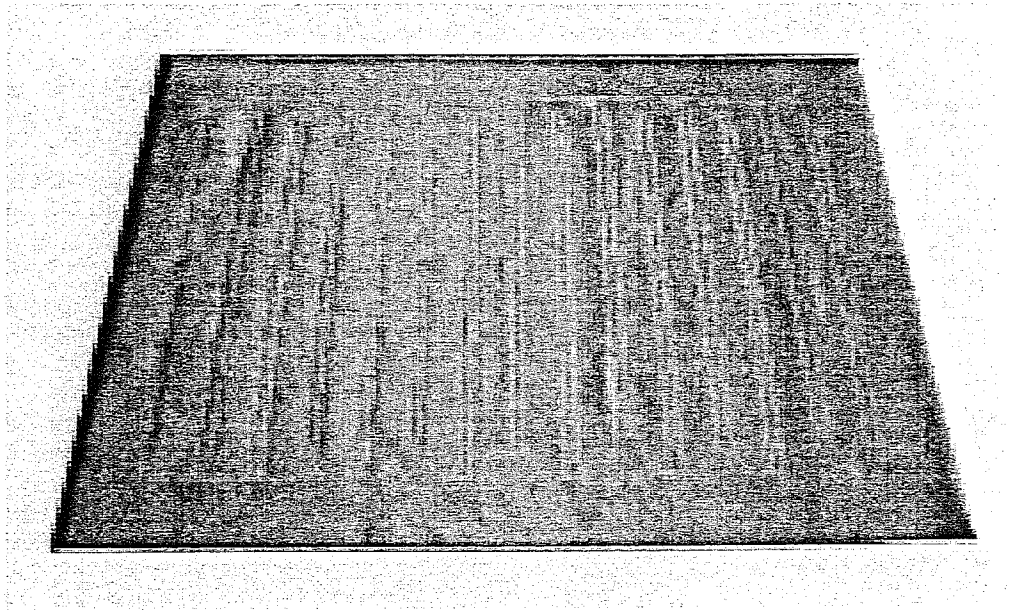
FIG. 4M presents a photograph of an incontinence sensor used with the invention.

FIG. 4C presents a screen shot of a computer display web portals 180 which communicate with support personnel for inventive operation. FIG. 4D presents a screen shot of a GUI presented to the monitoring or managing person when user is doing well. FIG. 4E presents a screen shot of a GUI presented to the monitoring or managing person when user needs assistance. FIG. 4F presents a screen shot of a GUI presented to the monitoring or managing person that shows a plan for the monitored person and the data for same over time, including hourly at the top and daily, weekly and monthly at the bottom. FIG. 4G presents a screen shot of a GUI presented to the monitoring or managing person to enable creating scenes/rules and changing settings. FIG. 4H presents a screen shot of a GUI presented to the monitoring or managing person highlighting multiple persons for monitoring resident in a senior living community. FIG. 4I presents a screen shot of a GUI presented on a cell phone to the monitoring or managing person when a monitored person user is doing well. FIG. 4J presents a screen shot of a GUI presented to the monitoring or managing person regarding a floor sensor. FIG. 4K presents a photograph of a floor sensor used with the invention. FIG. 4L presents a screen shot of a GUI presented to the monitoring or managing person regarding an incontinence sensor. The incontinence sensor of FIG. 4L is able to work with any Z-Wave device e.g. lights, appliances, thermostats, etc. FIG. 4M presents a photograph of an incontinence sensor used with the invention. FIG. 5 is a chart highlighting the salient points distinguishing the system of this invention from other systems used to monitor senior citizens and infirm people, as well as for those with functional impairments or who are chronically ill.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A hands-free assistive and preventive remote monitoring system, comprising:

at least one sensor network comprising a plurality of sensors dispersed in a living environment of an infirm or aged person, or for persons with functional impairments or who are chronically ill;

a gateway connected to each of the at least one sensor network and configured to route communications to and from the sensor network, including emails and text messages; and a server configured to manage the sensor network and the communications, including receiving the communications from the sensor network and sending the communications and control signals to the gateway or sensors in the at least one sensor network to enable access to sensor data by a variety of support personnel, wherein the communications include data on a state of the infirm or aged person or person with functional impairments or who is chronically ill in the living environment;

wherein the server provides a user interface object to an electronic processing device associated to the support personnel that enables the support personnel to define rules for sensor operation including identifying linked sensor events to help diagnose underlying problems, and setting timer trigger points according to individual patterns of behavior, to access and control the operation of the sensors at the living environment and to view the sensor data in real time; and said system being without body worn transmitter alert devices or emergency pendant or any device attached to said person.

2. The hands-free assistive and preventive remote monitoring system of claim 1, wherein the gateway operates according to a short-range wireless protocol optimized for reliable, low-latency communications of small data packets.

3. The hands-free assistive and preventive remote monitoring system of claim 2, wherein the short range wireless protocol is Z-Wave.

4. The hands-free assistive and preventive remote monitoring system of claim 1, wherein the support personnel are any of the group consisting essentially of medical professionals, caregivers, 24-hour monitoring employees, family members and neighbors.

5. The hands-free assistive and preventive remote monitoring system of claim 4, wherein the server processes the sensor data to monitor the activities of the aged or infirm person or person with functional impairments or who is chronically ill at the living environment in accordance with a set of rules.

6. The hands-free assistive and preventive remote monitoring system of claim 5, wherein the processing includes relaying sensor-detected events to appropriate support personnel based on custom alerts related to pre-defined alert reception schedules for the support personnel entered through the server, a sensor placed in an area where medication is stored so that in the event there is no activity would indicate that the person is not taking prescribed medication, or if there is too much activity could indicate that the person is taking too much medication.

7. The hands-free assistive and preventive remote monitoring system as in claim 4, wherein the server is programmed to analyze activity of the aged or infirm person or person with functional impairments or who is chronically ill and the living environment, to characterize detected activity and environmental conditions as events and to respond to the events.

8. The hands-free assistive and preventive remote monitoring system as in claim 7, wherein the server notifies the support personnel of the events.

9. The hands-free assistive and preventive remote monitoring system as in claim 7, wherein the server notifies any of police-related emergency service providers, fire-related emergency service providers and first responder medical service providers.

10. A computer-based method of monitoring a state of a person in a living space or the state of the living space to optimize the monitored person's well-being, the method comprising the steps of:

arranging a plurality of sensors in predetermined positions within the living space for generating sensor data;

connecting each of the sensors to a gateway node in the living space, the gateway node configured for routing communications to and from the sensors in the sensor network; and operating a server including a processor and a memory that is programmed to communicate with the gateway node to receive data detected by the sensors, to process the sensor data received from the sensor network and to generate communications based on the processing in accordance with a set of rules;

wherein the operating includes providing a user interface object to an electronic processing device associated with support personnel that enables the support personnel to define rules for sensor operation including identifying linked sensor events to help diagnose underlying problems, and setting trigger points according to individual patters of behavior, as well as to access and control the operation of the sensors at the living space to view the sensor data in real time;

said system being without body worn transmitter alert devices or emergency pendant or any device attached to said person.

11. The computer-based method as set forth in claim 10, wherein the step of operating includes controlling one or more of the sensors according to one or more of a set of rules.

12. The computer-based method as set forth in claim 11, wherein the one or more of the set of rules define events at the particular sensor.

13. The computer-based method as set forth in claim 12, wherein the one or more set of rules define events or trigger points according to individual patterns of behavior of the infirm or aged person, or for the persons with functional impairments or who are chronically ill and living in the environment.

14. The computer-based method as set forth in claim 13, wherein the step of operating includes notifying support personnel in response to processing received event-driven signals sent from the gateway node, including from a sensor placed in an area where medication is stored so that in the event there is no activity would indicate that the person is not taking prescribed medication, or if there is too much activity could indicate that the person is taking too much medication.

15. The computer-based method as set forth in claim 10, wherein one of the sensors is a camera that provides video data from the living space and wherein the user interface object enables the support personnel to view the living space thereby.

16. A computer program product having program code means that are stored in memory on a non-transitory computer-readable data carrier, for performing all the steps of the method as defined by claim 10, when the program code means is executed on the processor.

17. The hands-free assistive and preventive remote monitoring system as set forth in claim 1, wherein in response to certain conditions detected from the sensor data, the server automatically activates at least one device at the living environment.

18. The hands-free assistive and preventive remote monitoring system as set forth in claim 9, wherein the at least one device activated at the living environment is any of a light or lamp, alarm and a camera.

19. The computer-based method as set forth in claim 10, wherein the step of operating includes the server automatically activating at least one device at the living space in response to certain conditions detected from the sensor data.

20. The computer-based method as set forth in claim 10, wherein the at least one device activated at the living space is any of a light or lamp, alarm and a camera.

* * * * *